United States Patent [19]

Gallagher

[11] 4,154,496

[45] May 15, 1979

[54] COUPLING ASSEMBLY FOR RESILIENT ELECTRICAL CONNECTOR COMPONENTS

[75] Inventor: David A. Gallagher, Romeoville, Ill.

[73] Assignee: Bunker Ramo Corporation, Oak Brook, Ill.

[21] Appl. No.: 836,325

[22] Filed: Sep. 26, 1977

[51] Int. Cl.[2] ..... H01R 13/54

[52] U.S. Cl. ..... 399/89 R; 339/89 M

[58] Field of Search ..... 339/89 R, 89 C, 89 M, 339/90 R, 90 C

[56] References Cited

U.S. PATENT DOCUMENTS

| | | | |
|---|---|---|---|
| 2,787,770 | 4/1957 | Arson | 339/90 R X |
| 2,945,203 | 7/1960 | Quackenbush | 339/89 R X |

*Primary Examiner*—Roy Lake
*Assistant Examiner*—E. F. Desmond
*Attorney, Agent, or Firm*—F. M. Arbuckle; William Lohff

[57] ABSTRACT

An assembly for coupling a resilient electrical connector component to another mateable connector component includes a shell engageable about the resilient component. The shell includes a plurality of axially cantilevered, circumferentially spaced fingers at one end thereof which surround the resilient component, the fingers including means for defining a substantially rigid circumferential bearing surface thereabout. An annular coupling member is provided which is engageable with the bearing surface for rotation about the shell and includes means for attachment to the mateable connector component. The coupling member and the bearing surface means are configured and arranged such that the inherent elasticity of the resilient component maintains the coupling member and bearing surface in cooperative engagement. Annular means may also be provided on the coupling member for engagement with the shell such that the elasticity of the resilient component inhibits decoupling of the coupling member once it is attached to the mateable connector component.

39 Claims, 6 Drawing Figures

COUPLING ASSEMBLY FOR RESILIENT ELECTRICAL CONNECTOR COMPONENTS

BACKGROUND OF THE INVENTION

This invention relates generally to electrical connector coupling devices and more particularly to coupling assemblies for resilient connector components. Specifically, the subject invention relates to an improved and simplified assembly for coupling a resilient connector component to another mateable connector component wherein the elasticity of the resilient component is utilized for maintaining the coupling assembly elements in cooperative relation.

Numerous arrangements for interconnecting electrical connector components are known including a wide variety of assemblies employing coupling rings. Generally, such assemblies include a threaded coupling ring rotatably mounted on one connector component and threadably engageable to a second connector component to couple the components and inter-engage the contact members carried by the components. Frequently, the coupling ring is fixed for rotation about a rigid plug component which is engageable with a rigid receptacle component. Furthermore, the coupling ring often functions as a ferrule when interconnecting the components.

A number of different arrangements are also known for resisting loosening or unthreading of such a coupling ring after the connector components have been firmly coupled together. One such common arrangement utilizes intermeshing teeth disposed on washer rings incorporated within the coupling assembly. Other arrangements utilize various spring devices to create a resistive force against decoupling. U.S. Pat. No. 3,917,373, issued Nov. 4, 1975 to George Peterson, and assigned to the assignee of the subject invention, discloses a coupling ring assembly wherein a ratchet mechanism is utilized to inhibit decoupling.

Such coupling assemblies and means for inhibiting decoupling have generally been complex and relatively expensive to construct. Furthermore, they have generally been employed with connector components constructed from rigid inflexible materials, thus requiring additional structural elements to securely maintain an assembled coupling ring in place about the rigid connector component. These additional structural elements increase the complexity of assembly as well as the cost of construction.

Some electrical connectors, particularly those adapted for use in harsh environments, utilize connector components constructed from resilient materials, such as rubber or other elastomeric material. Examples of such connector components are disclosed in my U.S. Pat. No. 3,930,705, issued on Jan. 6, 1976, and assigned to the assignee of the present invention. Many of the coupling assemblies discussed above may not be utilized with such resilient connector components in that they are integral parts of the rigid connector components themselves. Previous coupling ring assemblies which are associated with a resilient component or component insert of some type generally require a number of rigid structural support elements and do not utilize the inherent elasticity of the resilient component in their construction or operation. Therefore, such assemblies are complicated to operate and maintain and costly to construct.

SUMMARY OF THE INVENTION

Therefore, the present invention is directed to an improved and simplified coupling assembly for use with a resilient connector component which overcomes the above-mentioned deficiencies of prior coupling assemblies.

Particularly, it is an object of the present invention to provide an improved coupling assembly for coupling a first connector component to a second mateable component wherein the first connector component includes a resilient insert.

It is another object of the present invention to provide an improved coupling assembly for coupling a resilient connector component to another mateable component which utilizes the inherent elasticity of the resilient component to maintain the coupling assembly elements in cooperative relation.

It is a further object of the present invention to provide an improved coupling assembly for coupling a resilient connector component to another mateable component which permits the assembly thereof without the use of additional structural elements to secure the coupling assembly elements in operative relation and which is inexpensive and simple in construction.

Yet another object of the present invention is to provide an improved coupling assembly for coupling a resilient connector component to another mateable component which utilizes the inherent resiliency of the resilient component to inhibit decoupling of the coupled connector components.

Accordingly, the present invention is directed to an electrical connector coupling assembly for coupling a first connector component to a second mateable connector component wherein the first connector component includes a resilient elastomeric insert. The coupling assembly preferably includes a tubular shell for engagement about the resilient insert and which has a plurality of axially cantilevered, circumferentially spaced fingers at one end thereof. A substantially rigid circumferential bearing surface is defined about the outer annular surface of the fingers by a plurality of latch members projecting radially outwardly from the free ends of the fingers and a plurality of stop members projecting radially outwardly proximate the fixed ends of the fingers.

An annular coupling ring is also provided with an inner annular flange. The flange is cooperatively engageable with the bearing surface for rotation about the shell, and the ring includes means for attachment to the second connector component, which is preferably constructed from a rigid material. The coupling ring and the bearing surface are configured and arranged such that the inherent resiliency of the elastomeric insert maintains the coupling ring and the bearing surface in cooperative engagement. In addition, the fingers and latch members are adapted such that axial assembly of the coupling ring onto the shell deflects the latch members and fingers inwardly so as to receive the ring until it is fully positioned about the bearing surface, the resiliency of the insert returning the fingers and latch members to an undeflected position and maintaining them therein.

Key means are provided for cooperatively aligning the resilient insert, the shell and the second connector component such that the contact members disposed within the first and second connector components are in mating alignment. In preferred form, at least one of the fingers is absent so as to provide an axial key slot which engages a raised axial key member disposed on the resilient insert. Furthermore, at least one key projection is disposed on the shell in cooperative association with the key slot for engagement with a cooperating keyway disposed in the second connector component.

To inhibit decoupling of the ring from the second connector component when attached thereto, the stop members are disposed proximate the fixed ends of alternate fingers to provide gaps therebetween. A plurality of axially projecting detents are preferably spaced along one edge of the coupling ring's annular flange for intermeshing engagement with the spaced stop members. The resiliency of the elastomeric component provides a resistive force in opposition to coupling when the two connector components are brought into engagement such that rotation of the ring in a coupling direction interfaces the detents and stop members which inhibit decoupling of the ring unless the ring is intentionally rotated in a decoupling direction.

BRIEF DESCRIPTION OF THE DRAWINGS

The novel features which are believed to be characteristic of the present invention are set forth in the appended claims. The invention itself, however, together with further objects and attendant advantages thereof, will become apparent and best understood by reference to the following detailed description taken in connection with the accompanying drawings, setting forth by way of illustration and example certain embodiments of the invention in the several figures of which like reference numerals identify like elements, and in which:

DETAILED DESCRIPTION OF THE PREFERRED EMBODIMENT

Figure 1:
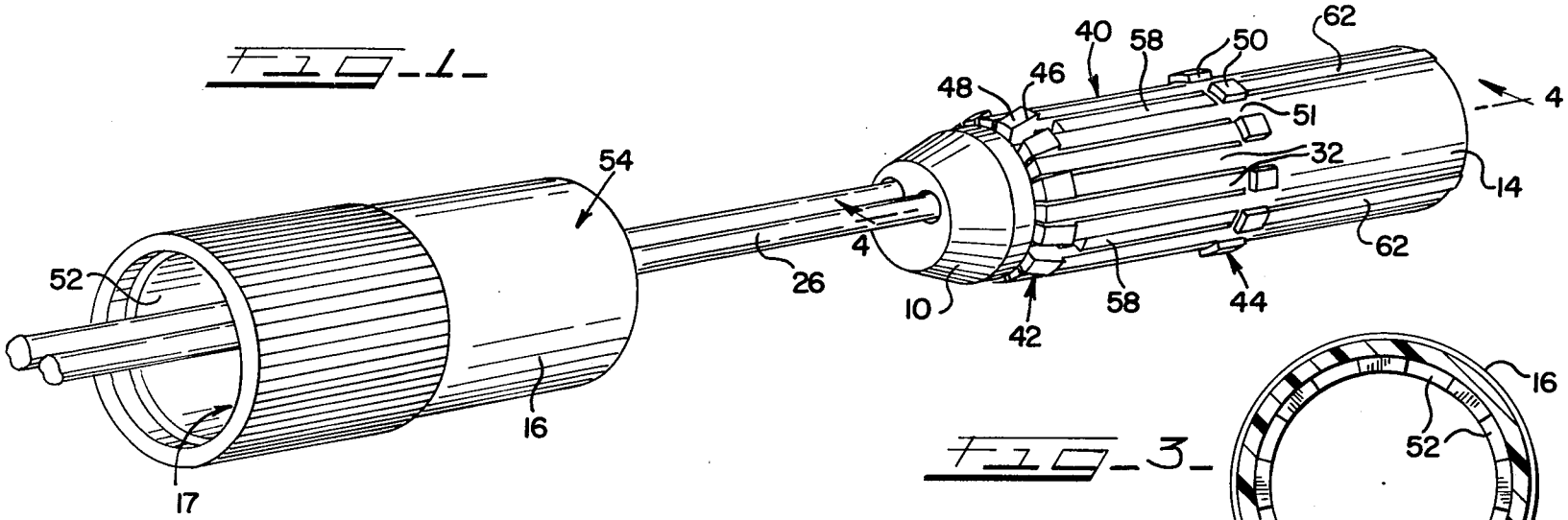
FIG. 1 is a perspective view of the coupling assembly of the present invention illustrating the shell engaged with a resilient connector component and the annular coupling member in its unassembled state.
Figure 3:
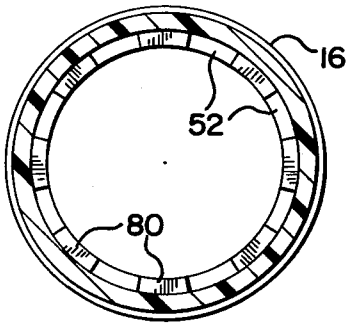
FIG. 3 is a cross-sectional view taken substantially along line 3—3 of FIG. 2.
Figure 2:
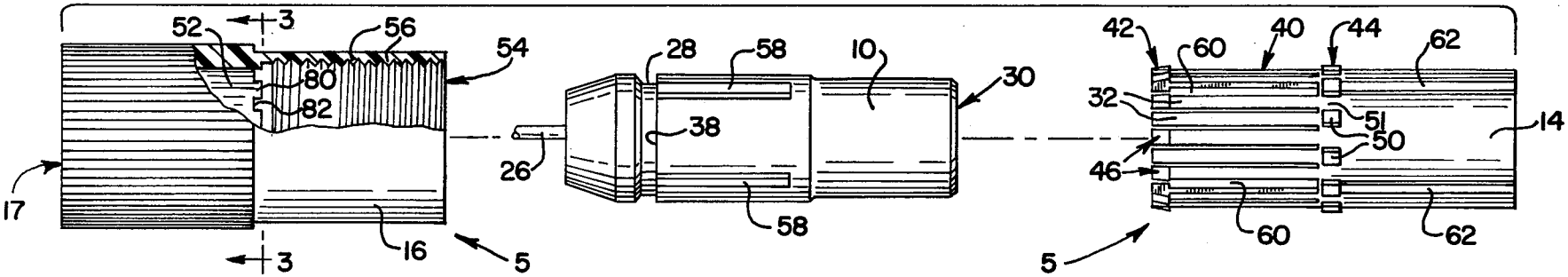
FIG. 2 is a side elevation view, with some parts broken away, of an unasssembled coupling assembly of the present invention and resilient connector component.
Figure 4:
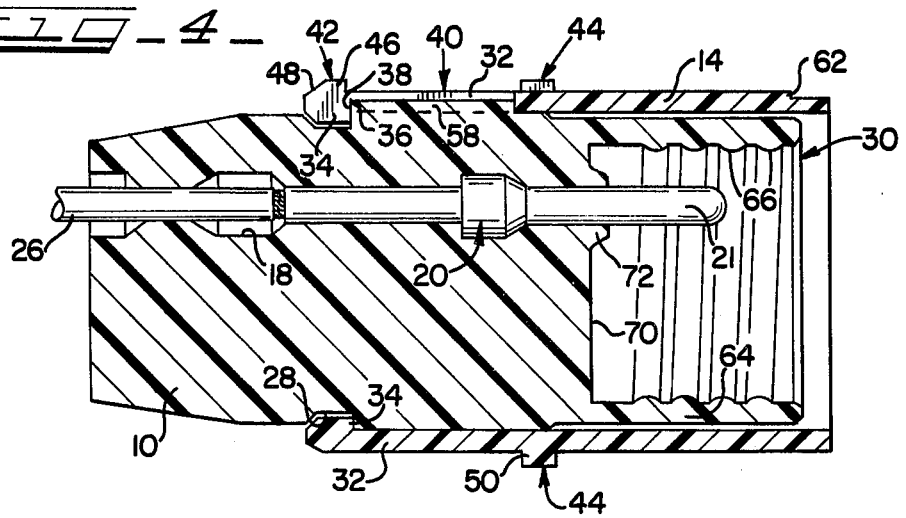
FIG. 4 is a cross-sectional view taken substantially along line 4—4 of FIG. 1.
Figure 5:
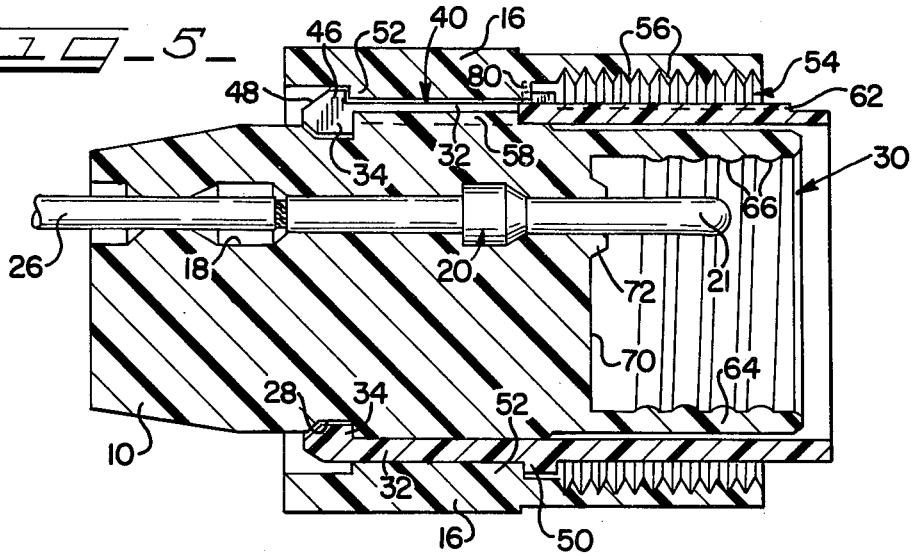
FIG. 5 is a view similar to FIG. 4 but illustrating the coupling ring fully assembled on the shell of the present invention.
Figure 6:
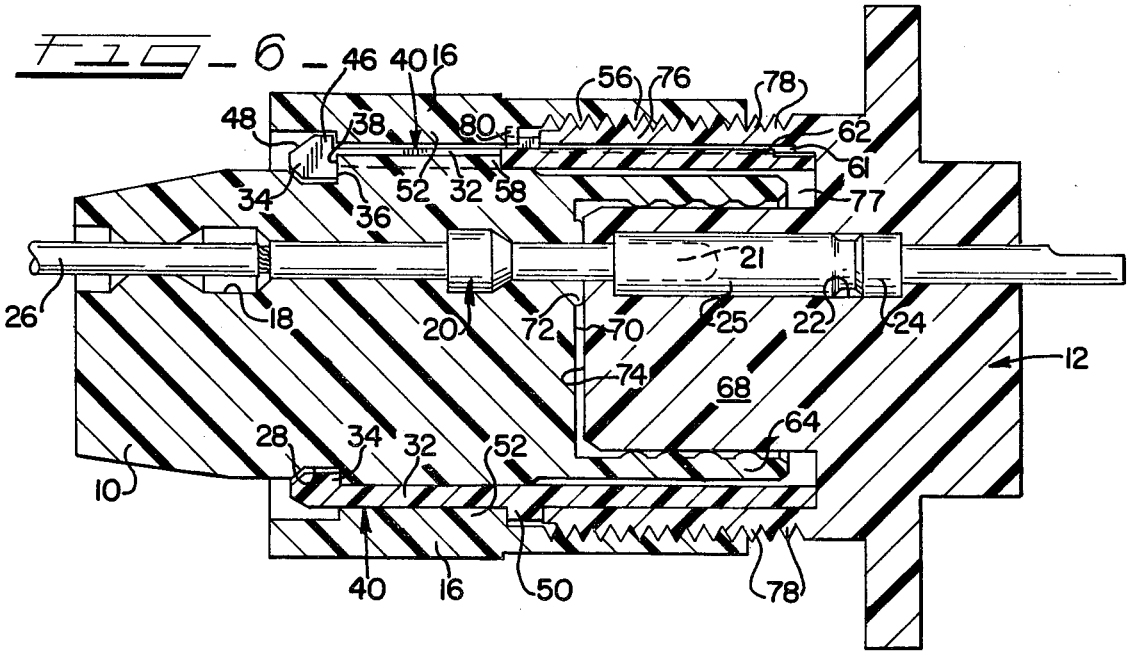
FIG. 6 is a view similar to FIG. 5 but illustrating the resilient connector component and assembled coupling assembly of the present invention engaged with a rigid second connector component.

Referring to FIGS. 1 and 2, a coupling assembly 5 is provided for coupling a resilient electrical connector component 10 to a second mateable connector component 12 (FIGS. 4–6). The coupling assembly 5 includes a shell 14 and an annular coupling member 16 having a central aperture 17. The resilient connector component 10 is preferably constructed from any known elastomeric material such as rubber or the like and may comprise the entire resilient connector component as illustrated in FIGS. 1–6 or be in the form of an insert member in a composite connector component (not illustrated). The second connector component 12 is preferably constructed from a rigid material such as plastic or metal, although a resilient material having a rigid outer housing may also be utilized.

Referring to FIGS. 4–6, the resilient connector component 10 includes a plurality of axial channels 18 which contain a plurality of electrical contact members 20 which preferably include active pin contact elements 21. The second connector component 12 likewise includes a plurality of axial channels 22 which contain a plurality of electrical contact members 24, preferably including active socket contact elements 25 which are mateable with the pin contact elements 21. An electrical conductor 26 is electrically secured to each contact member 20 and projects outwardly from the resilient connector component 10. It should be noted that the particular arrangement of the contact members 20 and 24 and the conductor 26 illustrated herein is merely one of any number of different types of arrangements known to the art which may be utilized with the present invention, examples of other arrangements being illustrated in my previously described U.S. Pat. No. 3,930,705.

Referring to FIGS. 1–6, the resilient connector component 10 is preferably substantially cylindrical in shape and includes an annular groove 28 disposed thereabout and spaced from the mating end 30 which is adapted for mateable engagement with the second connector component 12. The shell 14 is prferably in the form of an open-ended, substantially rigid tubular body having a plurality of axially cantilevered, circumferentially spaced fingers 32 at one end thereof for surrounding the resilient component 10. As illustrated, the fingers 32 comprise approximately half the length of the tubular shell 14, which is preferably constructed from a rigid material such as plastic or metal.

The shell 14 is firmly engaged and maintained about the component 10 by a plurality of hook portions 34 projecting radially inwardly from the free ends of the fingers 32, each finger 32 preferably including one such hook portion 34. The hook portions 34 are sized and shaped to securely engage the groove 28 with the shoulder 36 of each hook portion 34 firmly abutting the inner annular edge 38 of the groove 28. The fingers 32 are constructed for flexibility in a radial direction yet are firmly supported along their inner surfaces in a substantially cylindrical position when engaged by the resilient component 10.

Means are provided on the shell 14 for defining a rigid bearing surface 40 and preferably include a first annular shoulder 42 and a second annular shoulder 44, each of which has an outer diameter greater than the diameter of the bearing surface 40. The first annular shoulder 42 is composed of a plurality of latch members 46 which project radially outwardly from the free ends of alternately spaced fingers 32. Each latch member 46 includes a longitudinal beveled cam surface 48 for slidably engaging the annular member 16 as described in detail below. The second shoulder 44 preferably includes a plurality of annular spaced stop members 50 which project radially outwardly from the shell 14 proximate the fixed ends of the cantilevered fingers 32. In preferred form, the stop members 50 are disposed proximate the fixed ends of the alternate fingers 32 which are spaced between the latch members 46 thereby forming gaps 51 between the stop members 50.

The annular member 16 is preferably in the form of a tubular coupling ring which includes an inwardly projecting flange 52 on the inner surface thereof. The flange 52 is sized and shaped for secure rotating engagement about the bearing surface 40 between the annular shoulders 42 and 44. The mating end 54 of the coupling ring 16 includes threads 56 for rotatably coupling the ring 16 to the second connector component 12. The threads 56 are preferably disposed on the inner annular surface of the ring 16 adjacent one edge 82 of the flange 52. It should be noted that any known means for coupling the ring 16 to the second component 12 may be utilized such as the described rotatable threads, a bayonet-type engagement mechanism, and the like.

To assemble the coupling assembly 5 of the present invention onto the resilient insert 10, the shell 14 is first slidably inserted onto the component 10 until the hook portions 34 engage the annular groove 28. The conductors 26, which are secured to the contact members 20, are then passed through the central aperture 17 of the ring 16, and the ring 16 is slidably inserted over the shell 14. As the flange 52 engages the cam surfaces 48, the latch members 46 and the fingers 32 are deflected radially inwardly so as to compress the resilient connector component 10, thereby permitting the flange 52 to slide over the latch members 46 until it completely engages the bearing surface 40. Once the flange 52 has fully engaged the bearing surface 40, the inherent resiliency of the connector component 10 forcibly returns the latch members 46 and the fingers 32 to their undeflected, cylindrical position about the component 10 so as to engage and maintain the flange 52 within the bearing recess defined by the bearing surface 40 and the annular shoulders 42 and 44. The flange 52 and the bearing surface 40 are, therefore, configured and arranged such that the resiliency of the first connector component 10 maintains the ring 16 and the bearing surface 40 in cooperative engagement whereby the ring 16 is securely maintained in engagement with the bearing surface 40 yet is free to rotate thereabout to provide the coupling function described below.

Referring particularly to FIGS. 1 and 3, means for keying and properly aligning the shell 14 with the resilient connector component 10 are provided and include at least one and preferably a plurality of raised key members 58 disposed axially along the outer surface of the component 10, and an equal number of key slots 60 disposed along the length of the shell 14 in annular alignment with the members 58. In preferred form, the keying members 58 are composed of the same resilient material from which the component 10 is constructed, and each key slot 60 is a void space dreated by eliminating a finger 32. By this arrangement, the key members 58 align and aid in firmly maintaining the shell 14 in place about the resilient connector component 10.

Cooperatively associated with the key members 58 and the slots 60 are a plurality of keying projections 62 axially disposed along the outer surface of shell 14 for engagement with cooperating keyways 61 (FIG. 6) disposed in the second connector component 12. The keying projections 62 are cooperatively associated with the members 58 and the slots 60 such that the plurality of contact members 20 are in proper alignment for mating engagement with the plurality of contact members 24 when the connector components 10 and 12 are coupled together.

Turning to FIGS. 4–6, the resilient connector component 10 may be in the form of either a plug or a receptacle with the second connector component 12 being of the opposite form. In the illustrated embodiment, the component 10 is in the form of a receptacle, and the mating end 30 includes a tubular recess 64 having internal resilient annular ribs 66 for creating friction resistance against the plug member 68 of the component 12 during mating engagement of the two components 10 and 12. An inner transverse resilient face 70 at the base of the recess 64 includes at least one and preferably a plurality of resilient compressible knob members 72 in the form of sleeves which extend outwardly from the face 70 and surround portions of the mating ends of the contact elements 20. The sleeves 72 function to aid in sealing the internal contact area between the contact members 20 and 24 as well as provide a variable resistive force in opposition to mating of the components 10 and 12, the plug 68 preferably being of a rigid plastic material. As the plug 68 is inserted within the recess 64, the forward face 74 of the plug 68 contacts and compresses the sleeves 72 as the contact elements 20 and 24 interengage, thereby creating the resistive force against mating.

A cylindrical housing 76 projects longitudinally from the component 12 and is spaced radially outwardly from the plug 68 to provide an annular gap 77 therebetween for reception of the shell 14 and the mating end 30 of the component 10. Radial threads 78 are provided about the outer surface of the housing 76 for engagement with the threads 56 of the ring 16. Thus, to achieve coupling of the components 10 and 12, the plug 68 of the component 12 is inserted within the recess 64 of the component 10 with the shell 14 and the ring 16 disposed thereabout. As the plug 68 is so inserted, the coupling ring 16 is rotated in a coupling direction so as to engage the threads 56 with the threads 78. As the ring 16 is rotated in a coupling direction, the plug 68 is drawn further into the recess 64 until the contact elements 20 and 24 engage and mate, the plug 12 being in proper alignment due to the keying components 62, 61, 60 and 58. A slignt resistive force against coupling is initially provided by the annular ribs 66 so as to create a slight resistance against coupling rotation of the ring 16. Upon engagement of the forward face 74 of the plug 68 with the sleeve members 72, a considerable resistive force against coupling is created. The greater the compression of the resilient sleeve members 72 of the resilient component 10, the greater the resistive force against coupling. This compression of the sleeve members 72 and the resultant resistive force is due to the inherent resiliency of the connector component 10 and is utilized to inhibit decoupling of the ring 16 as described below.

Anti-decoupling mechanisms for connector coupling assemblies are highly desirable when such connectors are subjected to considerable vibration and the like. With particular reference to FIGS. 2 and 3, the present invention achieves this function by including a plurality of axially projecting detents 80 circumferentially spaced along the edge 82 of the flange 52, the edge 82 being the edge closest to the mating end 30 of the resilient connector component 10. The detents 80 are spaced in such a manner as to fit within the gaps 51 between the stop members 50 when the coupling ring 16 is subjected to a resistive force against coupling. Thus, as the coupling ring 16 is rotated in a coupling direction, the resistive force offered by the annular ribs 66 is sufficient to interface the detents 80 with the stop membesr 50 so that the interfacing arises from the actual coupling of the components 10 and 12. However, such interfacing is slight and is overcome by minor axial force directed away from the component 12 when rotating the ring 16 in a coupling direction. This permits easy coupling of the ring 16 to the component 12.

However, when the plug 68 has been inserted within the recess 64 so that its face 74 engages and compresses the resilient sleeve members 72 to create a large resistance against mating and coupling, the force between the intermeshed detents 80 and stop members 50 is sufficiently great to limit additional rotation of the coupling ring 16 in a coupling direction. Likewise, however, this same intermeshing force between the detents 80 and the stop members 50 caused by the large resistive force of the sleeve members 72 inhibits rotation of the ring 16 in a decoupling direction thereby inhibiting decoupling of the ring 16 from the connector component 12, the detents 80 and the stop members 50 tending to remain in one intermeshed position. This state can be overcome to permit disassembly of the mated components 10 and 12 only by considerable axial force exerted on the ring 16 in conjunction with rotation of the ring 16 in a decoupling direction. Thus, the simple addition of the detents 80 to the flange 52 such that they intermesh with the stop members 50 provides an effective yet simple anti-decoupling mechanism.

As can be seen from the above, the present invention provides an effective yet simple and inexpensive coupling assembly for interconnecting a resilient connector component with a second mateable component. The present invention avoids the complex design and construction of prior coupling assemblies due to its use of the inherent elasticity of the resilient connector component for maintaining the coupling assembly in engagement therewith as well as maintaining the coupling ring and shell in cooperative relation. Furthermore, the present invention also utilizes the inherent elasticity of the resilient component to inhibit decoupling of the coupled connector components. Finally, inasmuch as the subject coupling assembly is not integral with the connector component, it may be utilized with any number of different resilient connector components having the same basic dimensions.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein but may be modified within the scope of the appended claims.

I claim:

1. An assembly for use in coupling a resilient connector component to another mateable component comprising:

an annular member engageable about said resilient connector component and including flexible means for mounting and securing said annular member about said resilient connector component and for defining a circumferential bearing surface thereabout; and coupling means engageable with said bearing surface of rotation about said annular member and including means for attachment to said mateable component, said flexible means being constructed and arranged to coact with said resilient connector component to permit mounting of said coupling means about said bearing surface and to maintain said coupling means in rotatable engagement with said bearing surface.

2. The assembly as described in claim 1, wherein said flexible means includes means for preventing axial displacement of said coupling means from said circumferential bearing surface.

3. The coupling assembly as described in claim 2, wherein said means for preventing axial displacement comprises a plurality of radially outwardly projecting stop members disposed circumferentially about said annular member at one axial end of said bearing surface, a plurality of radially outwardly projecting latch members spaced circumferentially about said annular member at the opposite axial end of said bearing surface, and a radially inwardly projecting annular flange disposed on said coupling means for rotational engagement between said stop members and said latch members, said latch members including means for slidably engaging said annular flange to deflect said flexible means radially inwardly and compress said resilient component as said coupling means is inserted onto said annular member.

4. The assembly as described in claim 1, wherein said flexible means includes means for releasably engaging said resilient connector component to secure said annular member about said resilient connector component.

5. The assembly as described in claim 1, wherein said flexible means includes a plurality of flexible members adapted for utilizing the resiliency of said resilient connector component to permit said mounting and maintaining of said coupling means about said bearing surface.

6. The coupling assembly as described in claim 1, wherein said coupling means comprises a tubular ring having a radially inwardly projecting annular flange for engagement with said bearing surface.

7. The coupling assembly as described in claim 1, wherein said coupling assembly further includes means for inhibiting decoupling of said coupling means when attached to said mateable component.

8. The coupling assembly as described in claim 1, wherein said assembly further includes means for keying said annular member to said resilient connector component in cooperation with keying projections disposed on said annular member for aligning said assembly with said mateable component.

9. The coupling assembly as described in claim 4, wherein said annular member comprises a shell having an open-ended, substantially rigid tubular body, and wherein said flexible member comprises a plurality of axially cantilevered, circumferentially spaced fingers at one end of said shell for surrounding said resilient connector component.

10. The coupling assembly as described in claim 9, wherein the free ends of said cantilevered fingers include a plurality of radially inwardly projecting hook portions for engagement with an annular groove disposed in said resilient connector component, said hook portions maintaining said fingers in position about said resilient connector component, said resilient component tending to resist inward radial movement of said fingers.

11. The coupling assembly as described in claim 9, wherein said shell includes at least one axial key slot disposed between said fingers for engagement with a raised axial key member disposed on said resilient connector component, and at least one keying projection disposed on said shell in cooperative association with said key slot for engagement with a cooperating keyway disposed in said mateable component.

12. The coupling assembly as described in claim 9, wherein said bearing surface is defined on said flexible members by a plurality of radially outwardly projecting latch members disposed along the free ends of said fingers, and a plurality of radially outwardly projecting stop members spaced circumferentially about said shell proximate the fixed ends of said fingers, said bearing surface comprising the outer annular surface of said fingers disposed between said latch and stop members.

13. The coupling assembly as defined in claim 12, wherein said stop members are disposed proximate the fixed ends of alternate fingers, and wherein said coupling means comprises an annular coupling member having a plurality of annularly spaced detents projecting radially inwardly from the inner surface thereof for intermeshing engagement with said spaced stop members to inhibit decoupling of said coupling member when attached to said mateable component.

14. The coupling assembly as described in claim 12, wherein said coupling means comprise an annular coupling member having a radially inwardly projecting annular flange for engagement with said bearing surface, and wherein each said latch member includes a beveled cam surface for slidably engaging said annular flange to deflect said fingers radially inwardly and compress said resilient component as said ring is inserted onto said shell.

15. The coupling assembly as described in claim 14, wherein said stop members are disposed proximate the fixed ends of alternate fingers, and wherein said annular flange includes a plurality of axially projecting detents circumferentially spaced along one edge thereof for intermeshing engagement with said spaced stop members to inhibit decoupling of said coupling member when attached to said mateable component.

16. In an electrical connector assembly including a resilient connector component having at least one electrical contact member disposed therein, said resilient connector component having one end adapted for mating engagement with a rigid connector component, and a coupling device for coupling said resilient connector component to said rigid component, the improvement wherein said coupling device comprises an annular member removably engaged about said resilient connector component and including flexible means for mounting and securing said annular member about said resilient connector component and for defining a circumferential bearing surface thereabout, and coupling means removably engaged with said bearing surface for rotation about said annular member and including means for attachment to said rigid component, said flexible means being constructed and arranged to coact with said resilient connector component to permit mounting of said coupling means about said bearing surface to maintain said coupling means in rotatable engagement with said bearing surface.

17. The improvement as described in claim 16, wherein said coupling device further comprises means for keying said annular member to said resilient component in cooperation with keying projections disposed on said shell for aligning said device with said rigid component, and means for inhibiting decoupling of said coupling device when attached to said rigid component.

18. The improvement as described in claim 16, wherein said annular member comprises a shell having an open-ended, substantially rigid tubular body, and wherein said flexible means comprises a plurality of axially cantilevered, circumferentially spaced fingers for surrounding said resilient component and including means for engaging an annular groove disposed in said resilient connector component.

19. The improvement as described in claim 18, wherein said annular groove engaging means comprises a plurality of hook portions projecting radially inwardly from the free ends of said cantilevered fingers to engage said groove and maintain said fingers in substantially cylindrical position about said resilient component, said resilient component tending to resist inward radial movement of said fingers.

20. The improvement as described in claim 18, wherein said shell includes at least one axial key slot disposed between said fingers for engagement with a raised axial key member disposed on said resilient connector component, and at least one keying projection disposed on said shell in cooperative association with said key slot for engagement with a cooperating keyway in said rigid component.

21. The improvement as described in claim 18, wherein said bearing surface is defined by a plurality of latch members projecting radially outwardly from the free ends of said fingers, and a plurality of annularly spaced stop members projecting radially outwardly from said shell proximate the fixed ends of said fingers, said bearing surface comprising the outer annular surface of said fingers disposed between said latch and stop members.

22. The improvement as described in claim 21, wherein each said latch member includes a beveled cam surface for slidably engaging said coupling means as said coupling means is inserted onto said shell to deflect said fingers radially inwardly until said coupling means is fully engaged with said bearing surface, the elasticity of said resilient component forcibly returning said deflected fingers back into cylindrical position to cooperatively engage said latch members with said coupling means in its rotational position about said bearing surface.

23. The improvement as described in claim 21, wherein said stop members are disposed proximate the fixed ends of alternate fingers, and wherein said coupling means comprises an annular coupling member substantially in the form of a tubular ring having a radially inwardly projecting annular flange for engagement with said bearing surface, said flange including a plurality of axially projecting detents circumferentially spaced along one edge thereof for intermeshing engagement with said spaced stop members to inhibit decoupling of said coupling member when attached to said rigid component.

24. The improvement as described in claim 23, wherein the face of said one resilient component end adapted to mate with said rigid component includes a plurality of resilient compressible knob members projecting axially outwardly therefrom to provide a variable resistive force in opposition to coupling of said components when contacted and compressed by said rigid component during coupling of said components, said resistive force tightly intermeshing said detents and stop members thereby inhibiting the decoupling of said coupling member from said rigid component.

25. The improvement as described in claim 24, wherein each said resilient knob member comprises a sleeve extending from said face about the end portion of one said contact member.

26. A coupling ring assembly for coupling an elastomeric electrical connector insert component to a rigid connector component comprising:

a substantially rigid tubular shell adapted for nonrotatable engagement about said elastomeric insert component and including means for defining an outer circumferential bearing recess thereon;

a coupling ring including an inner annular flange cooperatively engageable with said bearing recess for rotation about said shell and means for attachment to said rigid component, said recess and said flange being configured and arranged such that the elasticity of said insert component maintains said recess and flange in cooperative engagement;

means for keying said shell to said insert component in cooperation with keying projections disposed on said shell for aligning said assembly with said rigid component; and means for inhibiting decoupling of said coupling ring when attached to said rigid component.

27. The coupling ring assembly as described in claim 26, wherein said shell includes a plurality of axially cantilevered, circumferentially spaced fingers for surrounding said elastomeric insert component, and means for engaging an annular groove disposed in said elastomeric insert component.

28. The coupling ring assembly as described in claim 27, wherein said annular groove engaging means comprises a plurality of hook portions projecting radially inwardly from the free ends of said cantilevered fingers to engage said groove and maintain said fingers in substantially cylindrical position about said elastomeric insert component, said insert component resisting inward radial movement of said fingers.

29. The coupling ring assembly as described in claim 27, wherein said keying means comprise a plurality of axial key slots disposed about said shell between said fingers for engagement with a plurality of raised axial key members correspondingly disposed about said elastomeric insert component, and wherein said keying projections are disposed on said tubular shell in cooperative association with said plurality of key slots for engagement with a plurality of cooperating keyways disposed in said rigid connector component.

30. The coupling ring assembly as described in claim 27, wherein said means for inhibiting decoupling comprises a plurality of circumferentially spaced stop members projecting radially outwardly from said tubular shell proximate the fixed ends of alternate fingers, and a plurality of axially projecting detents spaced along one edge of said flange for intermeshing engagement with said spaced stop members to inhibit decoupling of said coupling ring when attached to said rigid component, the elasticity of said elastomeric insert component providing a resistive force to coupling of said components to afford firm interfacing of said detents and stop members.

31. The coupling ring assembly as described in claim 27, wherein said means for defining said circumferential bearing recess comprises a plurality of latch members projecting radially outwardly from the free ends of said cantilevered fingers, a plurality of annularly spaced stop members projecting radially outwardly from said shell proximate the fixed ends of said cantilevered fingers, and the outer annular surface of said fingers disposed between said outwardly projecting latch and stop members.

32. The coupling ring assembly as described in claim 31, wherein each said latch member includes a beveled cam surface for slidably engaging said annular flange to temporarily deflect said fingers radially inwardly into said insert as said coupling ring is inserted onto said shell, the elasticity of said insert component returning said deflected fingers to said cylindrical position to cooperatively engage said latch members with said flange in its rotational position within said bearing recess.

33. An assembly for coupling a first connector component to a second mateable connector component comprising:

a tubular shell having a plurality of axially cantilevered, circumferentially spaced fingers at one end thereof, said fingers defining an annular bearing surface having a given first diameter and including a plurality of latch members disposed on the free ends thereof, said latch members defining an annular shoulder with a second diameter greater than said first diameter;

an elastomeric insert disposed within and supporting said shell and fingers; and a coupling ring having a central aperture with a diameter greater than said first diameter and less than said second diameter, whereby axial assembly of said coupling ring onto said shell inwardly deflects said latch members and fingers to receive said ring until said ring is in rotational operating position about said bearing surface, the elasticity of said insert returning said fingers and latch members to an undeflected position.

34. An electrical connector comprising:

a first connector component including a resilient insert with at least one first electrical contact member embedded therein, an annular member removably engaged about said insert and including flexible means for mounting and securing said annular member about said resilient insert and for defining a circumferential bearing surface thereon, and coupling means having an inner annular flange cooperatively engaging said bearing surface for rotation about said annular member and including means for attachment to a second connector component, said flexible means being constructed and arranged to coact with said resilient insert to permit mounting of said coupling means about said bearing surface and to maintain said coupling means in rotatable engagement with said bearing surface; and a second connector component mateable with said first component and including at lest one second electrical contact member and means for attachment to said coupling means, whereby rotation of said coupling means in a coupling direction interengages said first and second components to effect mating and electrical connection between said first and second electrical contact members.

35. The electrical connector as described in claim 30, wherein said first connector component is substantially in the form of a receptacle with said coupling means comprising an annular coupling member having threads disposed on the inner surface thereof adjacent one edge of said annular flange, and said second connector component is substantially in the form of a plug, said attachment means including a rigid, annular surface having threads rotatably carried thereon for engagement with said coupling member threads.

36. The electrical connector as described in claim 30, wherein said annular member comprises a shell having a plurality of axially cantilevered, circumferentially spaced fingers on one end thereof surrounding said resilient insert, and wherein said circumferential bearing surface is defined by a plurality of latch members projecting radially outwardly from the free ends of said cantilevered fingers, and a plurality of circumferentially spaced stop members projecting radially outwardly from said shell proximate the fixed ends of said fingers, said bearing surface comprising the outer annular surface of said fingers disposed between said outwardly projecting latch and stop members.

37. The electrical connector as described in claim 36, wherein each said latch member includes a beveled cam surface for slidably engaging said annular flange during assembly of said first connector component to inwardly deflect said latch members and fingers as said coupling means is inserted onto said shell, the elasticity of said resilient insert returning said latch members and fingers to an undeflected position when said flange is fully engaged with said bearing surface.

38. The electrical connector as described in claim 36, wherein said stop members are disposed proximate the fixed ends of alternate fingers, and wherein said flange includes a plurality of axially projecting detents spaced along one edge thereof for intermeshing engagement with said spaced stop members to inhibit decoupling of said coupling means when attached to said second connector component, the elasticity of said insert providing a resistive force to coupling of said connector components to afford firm interfacing of said detents and stop members, whereby rotation of said coupling means in a coupling direction will interengage said detents and stop members, and said resiliency and resistive force will maintain such interfacing until disengagement of said detents and stop members.

39. An electrical connector comprising:

a first connector component including a resilient insert with at least one first electrical contact member embedded therein, an annular member removably engaged about said insert and including flexible means for mounting and securing said annular member about said resilient insert and for defining a circumferential bearing surface thereon, and coupling means having an inner annular flange cooperatively engaging said bearing surface for rotation about said annular member and including means for attachment to a second connector component, said flexible means being constructed and arranged to coact with said resilient insert to permit mounting of said coupling means about said bearing surface and to maintain said coupling means in rotable engagement with said bearing surface;

and a second connector component mateable with said first component and including at least one second electrical contact member and means for attachment to said coupling means, whereby rotation of said coupling means in a coupling direction interengages said first and second components to effect mating and electrical connection between said first and second electrical contact members.

* * * * *